US007437900B1

(12) United States Patent
Slone

(10) Patent No.: US 7,437,900 B1
(45) Date of Patent: Oct. 21, 2008

(54) EXTERNALLY RELEASABLE SECURITY BAR SYSTEM

(76) Inventor: Dennis Slone, 993 Richter Rd., Columbus, OH (US) 43223-3332

( * ) Notice: Subject to any disclaimer, the term of this patent is extended or adjusted under 35 U.S.C. 154(b) by 0 days.

(21) Appl. No.: 11/868,644

(22) Filed: Oct. 8, 2007

(51) Int. Cl.
*E05B 65/00* (2006.01)

(52) U.S. Cl. ..... 70/94; 70/101; 70/135; 70/139; 292/338; 292/DIG. 15; 292/DIG. 37

(58) Field of Classification Search ..... 70/93, 70/94, 101, 135, 139, 360, DIG. 64, DIG. 66; 292/262, 338, 339, 342, 343, DIG. 15, DIG. 37
See application file for complete search history.

(56) References Cited

U.S. PATENT DOCUMENTS

| | | | | | |
|---|---|---|---|---|---|
| 119,758 | A * | 10/1871 | Gyss | 70/94 |
| 840,486 | A | 1/1907 | Fuchs | |
| 843,527 | A * | 2/1907 | Fuchs | 70/94 |
| 963,527 | A * | 7/1910 | Dessauer et al. | 70/94 |
| 977,182 | A | 11/1910 | Fuchs | |
| 1,371,111 | A * | 3/1921 | Phillips | 70/94 |
| 1,558,917 | A * | 10/1925 | Perkins | 292/338 |
| 1,695,686 | A * | 12/1928 | Hess | 70/94 |
| 3,527,068 | A * | 9/1970 | Giardina et al. | 70/94 |
| 4,076,293 | A * | 2/1978 | Valles | 292/338 |
| 4,136,899 | A | 1/1979 | Frasher | |
| 4,213,315 | A | 7/1980 | Lewis | |
| 4,854,140 | A * | 8/1989 | Goodman | 70/100 |
| 5,340,175 | A * | 8/1994 | Wood | 292/339 |
| 6,454,323 | B1 * | 9/2002 | Mills | 292/339 |
| 6,709,034 | B2 * | 3/2004 | Michael | 292/336.3 |
| 7,021,683 | B2 | 4/2006 | Nissen | |

* cited by examiner

*Primary Examiner*—Lloyd A Gall
(74) *Attorney, Agent, or Firm*—Gallagher & Dawsey Co., LPA; Michael J. Gallagher; David J. Dawsey

(57) ABSTRACT

An externally releasable security bar system for mounting on an inside surface of an inwardly swinging door and engaging a floor surface to prevent unauthorized entry through the door is provided. The system may include a mounting plate, a bracing arm, a release pin, an actuation mechanism, and a locking mechanism. The bracing arm has a secured position in which a distal end of the bracing arm is in contact with the floor surface, and an unsecured position in which the distal end is elevated from the floor surface. The actuation mechanism transfers the release pin to an engaged position, which causes the bracing arm to pivot to the unsecured position to allow unimpeded entry through the door. The locking mechanism is provided to allow for selective operation of the actuation mechanism.

20 Claims, 7 Drawing Sheets

EXTERNALLY RELEASABLE SECURITY BAR SYSTEM

TECHNICAL FIELD

The present invention is related to security devices, and more particularly, to an externally releasable security bar system for mounting on an inside surface of an inwardly swinging door and engaging a floor surface to prevent unauthorized entry through the door.

BACKGROUND OF THE INVENTION

Nearly all doors used for entering and exiting homes, businesses, and other structures are equipped with a lock or a similar device designed to prevent the entry of unauthorized persons. One of the problems associated with a conventional lock is that the conventional lock is capable of being "picked" by someone with the proper skills. However, there are commercially available locks that are practically "pick-proof" by the average burglar or intruder.

Intruders have also breached locked doors by prying the door jamb with a crowbar or similar instrument. Typically with this method, the door jamb is damaged and the lock is effectively bypassed, thus allowing the intruder unimpeded entry into the structure.

There have been a number of devices designed over the years that function as a secondary measure to protect against a forced entry. These devices typically are in the form of a door brace that is wedged between the inside surface of the door and the floor surface. Some prior art door braces are only releasable from within the structure, and thus, are only suitable for use when an authorized person is inside the structure. On the other hand, several prior art door braces have the capability of being released from outside of the structure at the door's exterior.

The prior art door braces, however, have not achieved widespread commercial success for a number of reasons. One reason is that many of the prior art door braces get in the way of authorized entrants and must be stored when not in use. Another reason is that many of the door braces are unsightly, complex in construction, and expensive to manufacture. Additionally, some prior art door braces require special tools and experienced craftsmen to assemble and install.

There remains a need to provide an effective door brace that is inexpensive to manufacture, simple in construction, capable of installation by an average do-it-yourselfer, and is not an impediment to an authorized entrant or a storage problem.

SUMMARY OF THE INVENTION

In its most general configuration, the present invention advances the state of the art with a variety of new capabilities and overcomes many of the shortcomings of prior devices in new and novel ways. In its most general sense, the present invention overcomes the shortcomings and limitations of the prior art in any of a number of generally effective configurations. The instant invention demonstrates such capabilities and overcomes many of the shortcomings of prior methods in new and novel ways.

The present invention is an externally releasable security bar system for mounting on an inside surface of an inwardly swinging door and engaging a floor surface to prevent unauthorized entry through the door. The externally releasable security bar system may generally include a mounting plate, a bracing arm, a release pin, an actuation mechanism, and a locking mechanism.

The externally releasable security bar system is designed and configured for mounting on an inwardly swinging door. In one embodiment, a mounting plate may be fixedly secured to the inside surface of the door.

The externally releasable security bar system includes a bracing arm pivotally connected to the mounting plate. The bracing arm may have a proximal end and a distal end. The proximal end may be pivotally connected to the mounting plate to allow the bracing arm to pivot between a secured position and an unsecured position. The secured position corresponds to when the distal end is in contact with the floor surface, while the unsecured position corresponds to when the distal end is in a position elevated from the floor surface. Thus, when the bracing arm is in the secured position, the door is resistant to opening.

In one embodiment, the bracing arm may include an angled tip having an angle of about 20 degrees to about 30 degrees from the horizontal at the distal end to provide flush contact between the bracing arm and the floor surface. Additionally, the distal end may be provided with a friction enhancing surface to better engage the floor surface.

In another embodiment, the bracing arm may have a foot pivotally joined to the distal end of the bracing arm. The foot may be formed with a friction enhancing surface for engaging the floor surface.

In still another embodiment, the bracing arm may include a plurality of telescoping arm sections. The plurality of telescoping arm sections provides the user with the ability to selectively lengthen and shorten the bracing arm. In addition, the bracing arm may feature a spring loaded design to allow for extension and retraction of the bracing arm.

The externally releasable security bar system also includes a release pin. The release pin may be operable to pivot the bracing arm from the secured position to the unsecured position. The release pin may have a disengaged position where the release pin is not in contact with the bracing arm, which corresponds to the bracing arm secured position. Conversely, the release pin may have an engaged position where the release pin is in contact with the bracing arm, corresponding to the bracing arm unsecured position.

In one embodiment, the interface between the release pin and the bracing arm may comprise low-friction materials to allow for smooth pivoting of the bracing arm. Furthermore, the release pin may be a multi-section threaded pin to allow a user to selectively lengthen or shorten the release pin.

The externally releasable security bar system includes an actuation mechanism designed to transfer the release pin from the disengaged position to the engaged position. In one particular embodiment, the actuation mechanism may generally include a housing, a push button, and a spring. The housing may be formed with a seating recess, a stopping shoulder, and a handle. The push button may be designed to receive a portion of the release pin and may be configured to slidably cooperate with the seating recess. The push button may be configured to move between a non-compressed position and a compressed position. The spring may be sized to receive and encircle a portion of the release pin and may be configured to be compressed against the stopping shoulder. The release pin may also include a retaining ring. The retaining ring and the stopping shoulder help secure the spring in place within the housing and also provide surfaces between which the spring may be compressed.

In addition, the externally releasable security bar system includes a locking mechanism. The locking mechanism allows for the selective operation of the actuation mechanism. Thus, when the locking mechanism is locked, the actuation mechanism is inoperable such that the release pin cannot be transferred to the engaged position to pivot the bracing arm to the unsecured position. However, when the locking mechanism is unlocked, the actuation mechanism is operable to transfer the release pin to the engaged position, which causes the bracing arm to pivot to the unsecured position allowing for unobstructed entry through the door.

In still another embodiment, the externally releasable security bar system may further include a storage clip. The storage clip may be fixedly secured to the inside surface of the door and may be configured to retain a portion of the bracing arm of the externally releasable security bar system. In this embodiment, the bracing arm is pivotally connected to the mounting plate such that the bracing arm may pivot to a substantially vertical position to engage the storage clip. Thus, the storage clip helps eliminate any problem associated with storing the externally releasable security bar system.

In operation, an occupant would first open the door with the bracing arm in the unsecured position. When exiting through the door, the occupant may allow the bracing arm to pivot to the secured position with the distal end contacting the floor surface. The distal end will drag along the floor surface when door is closing until the door is completely closed. At this point, the bracing arm will be in the secured position. After exiting through the door, the occupant may lock the locking mechanism so that the actuation mechanism is disabled and cannot transfer the release pin to the engaged position.

Upon returning to the structure and desiring entry through the door, the occupant may unlock the locking mechanism so that the actuation mechanism is in an operable mode. Next, the occupant may use the actuation mechanism to transfer the release pin from the disengaged position to the engaged position. When the release pin is moved to the engaged position, the release pin causes the bracing arm to pivot to the unsecured position. In the unsecured position, the distal end is no longer in contact with the floor surface, and the occupant is able to open the door without obstruction. The occupant may then choose to lock the locking mechanism to disable the actuation mechanism before closing the door.

The instant invention enables a significant advance in the state of the art. The instant invention is, in addition, widely applicable to a large number of applications. Variations, modifications, alternatives, and alterations of the various embodiments may be used alone or in combination with one another, as will become more readily apparent to those with skill in the art with reference to the following detailed description of the preferred embodiments and the accompanying figures and drawings.

BRIEF DESCRIPTION OF THE DRAWINGS

Without limiting the scope of the present invention as claimed below and referring now to the drawings and figures:

DETAILED DESCRIPTION OF THE INVENTION

Figure 1:
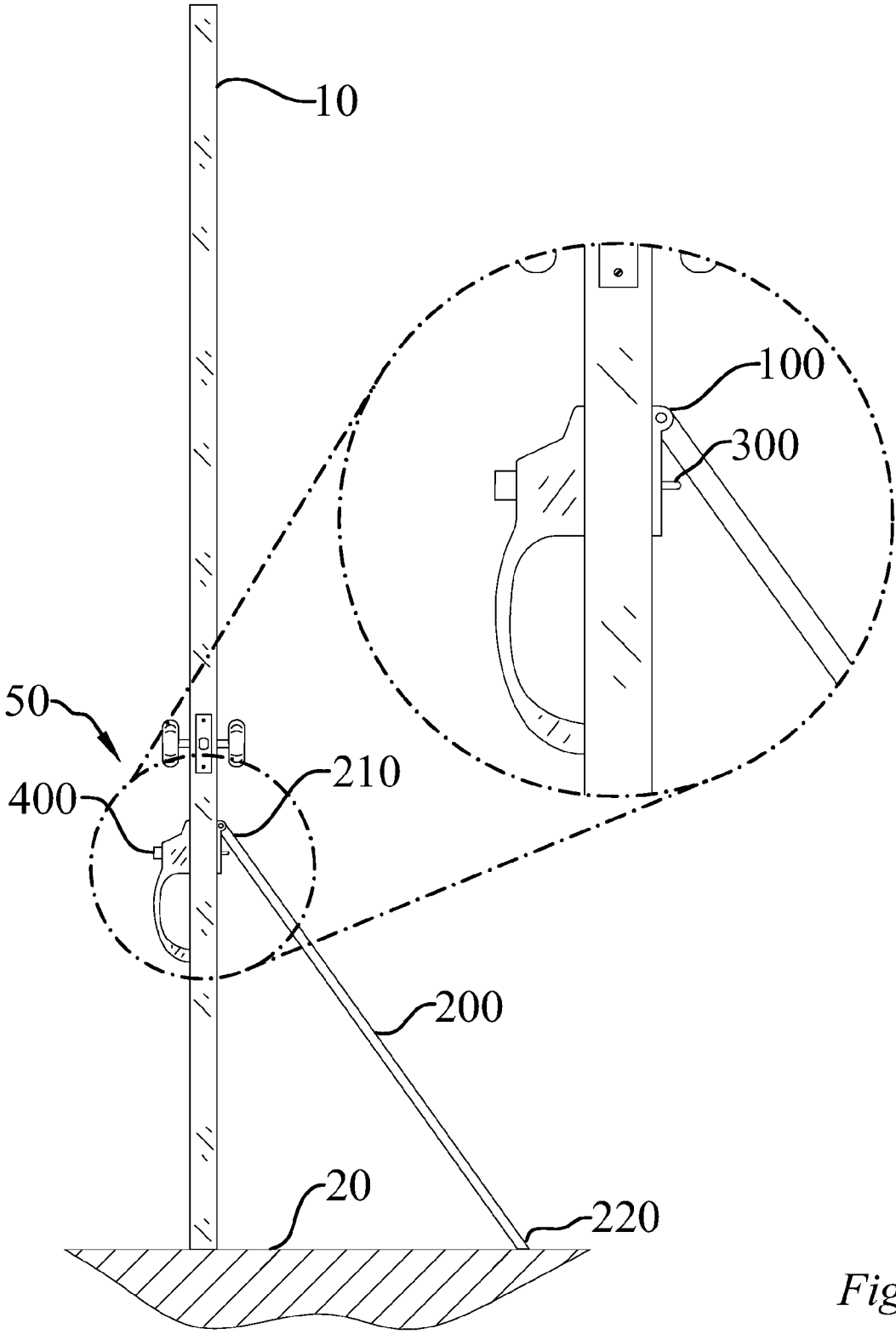
FIG. 1 is an elevation view of an embodiment of the externally releasable security bar system, not to scale.

An externally releasable security bar system (50) for mounting on an inside surface of an inwardly swinging door (10) and engaging a floor surface (20) to prevent unauthorized entry through the door (10) enables a significant advance in the state of the art. The preferred embodiments of the apparatus accomplish this by new and novel arrangements of elements that are configured in unique and novel ways and which demonstrate previously unavailable but preferred and desirable capabilities. The detailed description set forth below in connection with the drawings is intended merely as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention.

Referring generally to FIGS. 1 through 9, the present invention is an externally releasable security bar system (50) for mounting on an inside surface of an inwardly swinging door (10) and engaging a floor surface (20) to prevent unauthorized entry through the door (10). The externally releasable security bar system (50) generally comprises a mounting plate (100), a bracing arm (200), a release pin (300), an actuation mechanism (400), and a locking mechanism (500).

With reference now to FIG. 1, an embodiment of the externally releasable security bar system (50) is shown. As seen in FIG. 1, the externally releasable security bar system (50) is designed for mounting on an inwardly swinging door (10). A mounting plate (100) may be fixedly secured to the inside surface of the door (10). The mounting plate (100) may be secured by any number of effective means, including, but not limited to, screws and other types of mechanical fasteners, adhesives, or a combination of mechanical fasteners and adhesives.

Figure 3:
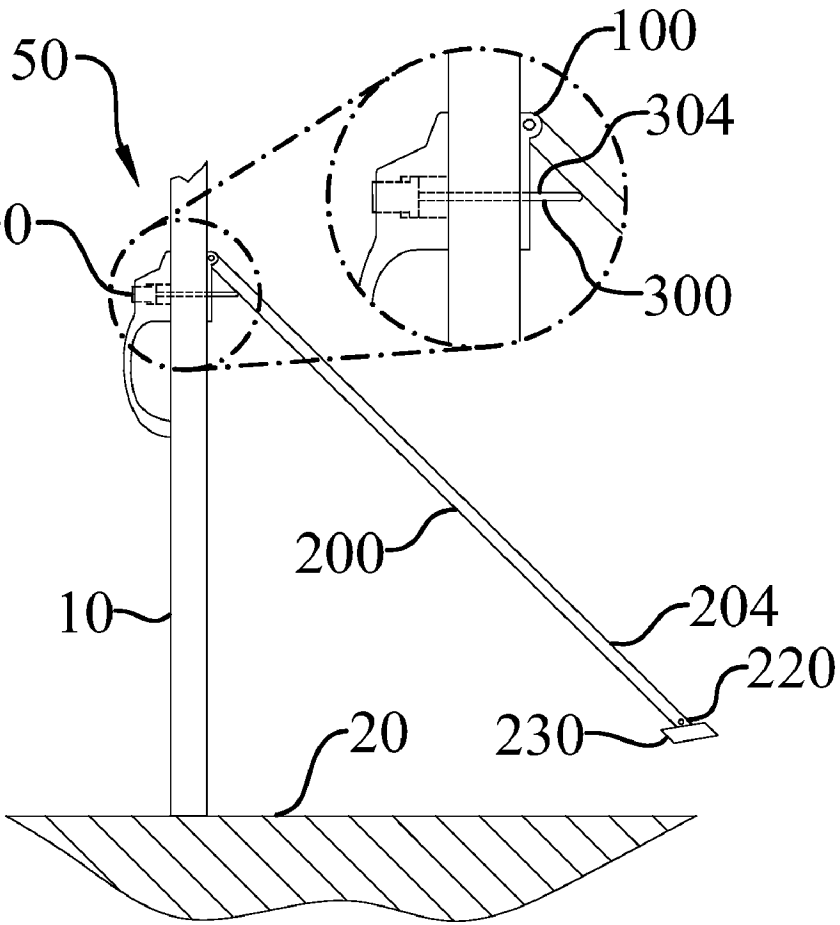
FIG. 3 is an elevation view of an embodiment of the externally releasable security bar system in the unsecured position, not to scale.
Figure 2:
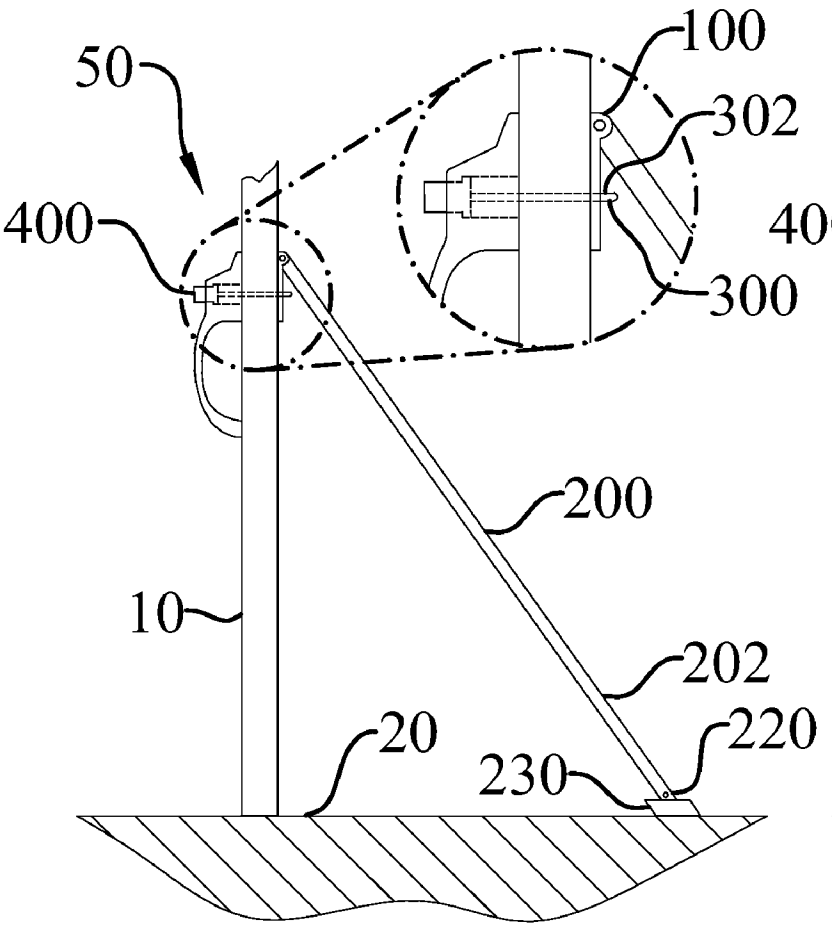
FIG. 2 is an elevation view of an embodiment of the externally releasable security bar system in the secured position, not to scale.

Still referring to FIG. 1, the externally releasable security bar system (50) includes a bracing arm (200). The bracing arm (200) has a proximal end (210) and a distal end (220). The proximal end (210) is pivotally connected to the mounting plate (100) to allow the bracing arm (200) to pivot between a secured position (202) and an unsecured position (204). As seen in FIGS. 2 and 3, the secured position (202) corresponds to when the distal end (220) is in contact with the floor surface (20), while the unsecured position (204) corresponds to when the distal end (220) is in a position elevated from the floor surface (20). When the bracing arm (200) is in the secured position (202), the door (10) is resistant to opening because the force applied to the door (10) tends to drive the bracing arm (200) against the floor surface (20). Of course, when the bracing arm (200) is in the unsecured position (204) the door (10) may be freely opened and closed.

The pivoting connection may be accomplished in a number of ways. For example, in one embodiment, the pivoting connection may be made by passing a shoulder bolt, or similar fastener, through mounting holes formed in the mounting plate (100) and the bracing arm (200), and securing the bolt with a washer and nut.

As previously mentioned, the distal end (220) of the bracing arm (200) is configured to contact the floor surface (20) when the bracing arm (200) is in the secured position (202). In one embodiment, the bracing arm (200) includes an angled tip, with an angle of about 20 degrees to about 30 degrees from the horizontal, at the distal end (220) to help engage the floor surface (20). Although an angle of about 20 degrees to about 30 degrees is specifically disclosed, one with skill in the art would appreciate that the angled tip may be formed with any number of angles, some larger than 30 degrees and some smaller than 20 degrees. Providing an angled tip at the distal end (220) allows for flusher contact between the bracing arm (200) and the floor surface (20). Additionally, the angled tip at the distal end (220) may have a friction enhancing surface to better engage the floor surface (20). For example, the angled tip at the distal end (220) may have a layer of rubber, or a similar material, that exhibits a high coefficient of friction when used in connection with a typical floor surface (20).

In another embodiment, the bracing arm (200) may have a foot (230). The foot (230) may be pivotally joined to the distal end (220) of the bracing arm (200), as seen in FIGS. 2 and 3. The foot (230) may be formed with a friction enhancing surface for engaging the floor surface (20). The friction enhancing surface for the foot (230) may be the same as that mentioned above for the distal end (220) friction enhancing surface.

Figure 8:
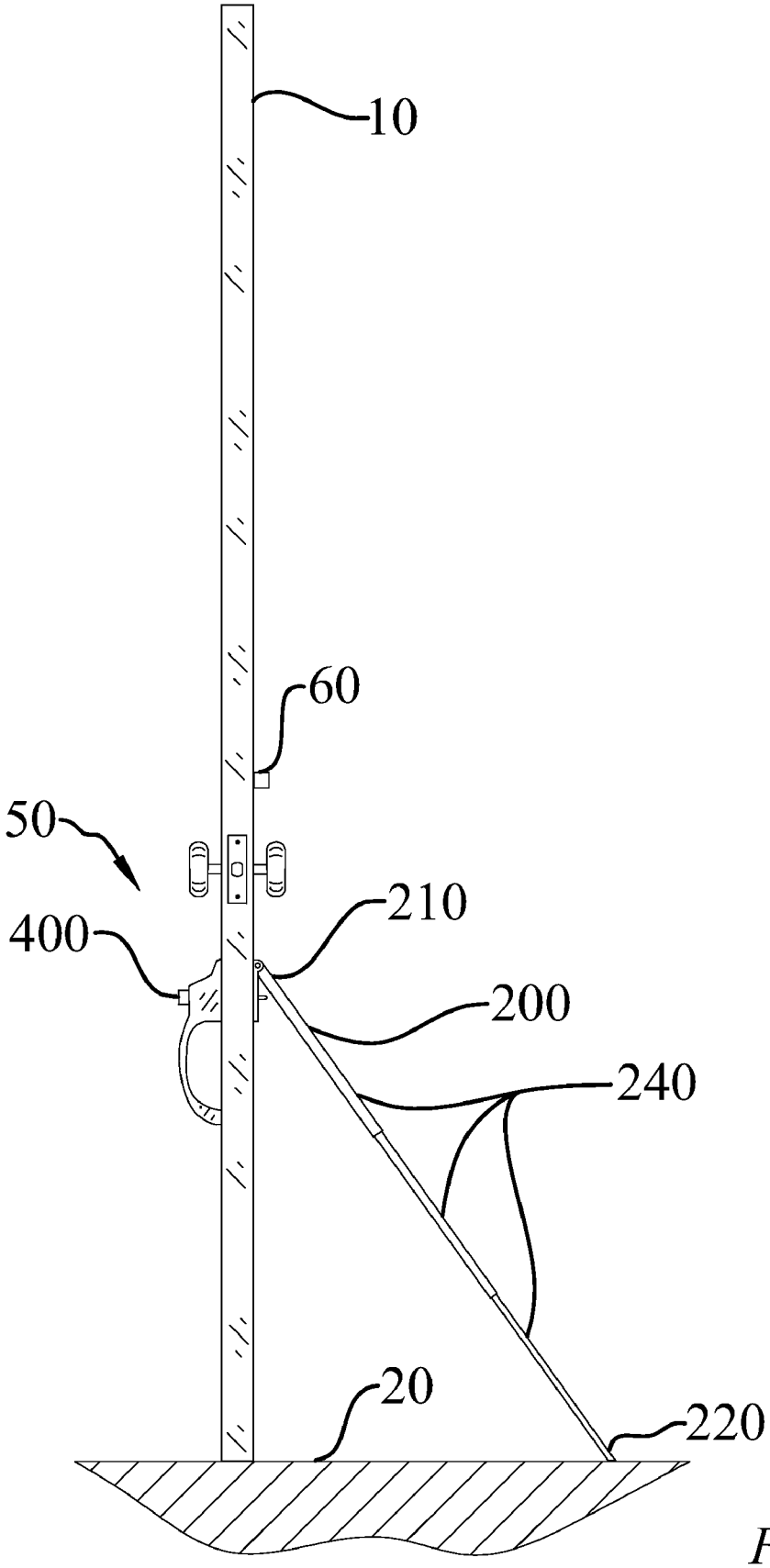
FIG. 8 is an elevation view of an embodiment of the externally releasable security bar system, not to scale.
Figure 9:
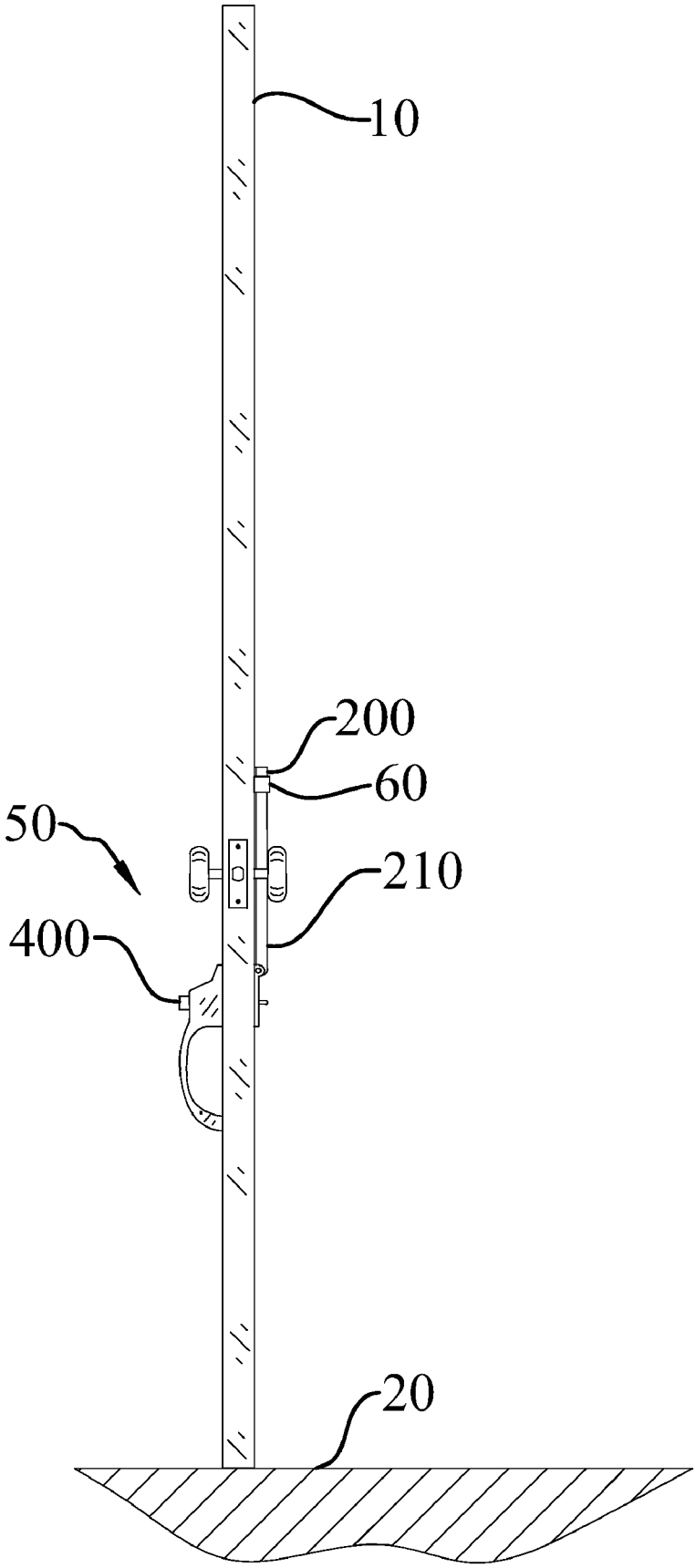
FIG. 9 is an elevation view of an embodiment of the externally releasable security bar system when not in use, not to scale.

In yet another embodiment, the bracing arm (200) may have a telescoping design. As seen in FIG. 8, the bracing arm (200) includes a plurality of telescoping arm sections (240). The plurality of telescoping arm sections (240) allow for selectively lengthening and shortening the bracing arm (200). The telescoping design provides several advantages. For example, the telescoping design allows a user to control how far the bracing arm (200) projects into the room. Another advantage is that the telescoping design accommodates a wide range of heights for mounting the externally releasable security bar system (50) to the door (10). Furthermore, the telescoping design improves the aesthetics of the externally releasable security bar system (50) by allowing the bracing arm (200) to be shortened, and thus less noticeable, during periods of nonuse, as seen in FIG. 9.

In still another embodiment, the bracing arm (200) having a plurality of telescoping arm sections (240) may feature a spring loaded design. The bracing arm (200) may feature a spring loaded design that allows for extension of the bracing arm (200) to the secured position (202). Additionally, the bracing arm (200) may feature a spring loaded design that allows for retraction of the bracing arm (200) to the unsecured position (204).

With reference now to FIGS. 2 and 3, the externally releasable security bar system (50) includes a release pin (300). The release pin (300) is operable to pivot the bracing arm (200) from the secured position (202) to the unsecured position (204). As seen in FIG. 2, the release pin (300) has a disengaged position (302) where the release pin (300) is not applying force to the bracing arm (200), which corresponds to the bracing arm (200) secured position (202). Conversely, and as seen in FIG. 3, the release pin (300) has an engaged position (304) where the release pin (300) is in contact with and applying force to the bracing arm (200), which corresponds to the bracing arm (200) unsecured position (204).

In one embodiment, the release pin (300) may be a multi-section threaded pin. Each section of the multi-section threaded pin may have a threaded female end and a threaded male end sized and configured for cooperative engagement with one another. By engaging or disengaging the threaded female end of a section with the threaded male end of a section, the release pin (300) may be selectively lengthened or shortened. The multi-section threaded pin allows a user to fine tune the pivoting movement of the bracing arm (200) to ensure that the distal end (220) of the bracing arm (200) is sufficiently distanced above the floor surface (20) to allow unobstructed entry through the door (10). Additionally, the multi-section threaded pin accommodates the use of adjustable bracing arm (200) designs, as well as a range of mounting heights, by providing a user with the ability to lengthen or shorten the release pin (300) to ensure the functionality of the externally releasable security bar system (50).

In order to ensure a smooth pivoting motion when the release pin (300) contacts the bracing arm (200), the interface between the release pin (300) and the bracing arm (200) may be a low-friction interface. For example, in one embodiment, the release pin (300) may include a roller tip for contacting the bracing arm (200). In operation, as the release pin (300) applies force to the bracing arm (200), the roller tip rolls along the bracing arm (200) resulting in the bracing arm (200) smoothly pivoting to the unsecured position (204). Additionally, a portion of the bracing arm (200) and the release pin (300) may be formed with low-friction materials, such as nylon, Teflon, or other smooth, synthetic materials.

Referring again to FIGS. 2 and 3, the externally releasable security bar system (50) includes an actuation mechanism (400). The actuation mechanism (400) is designed to transfer the release pin (300) from the disengaged position (302) to the engaged position (304).

Figure 4:
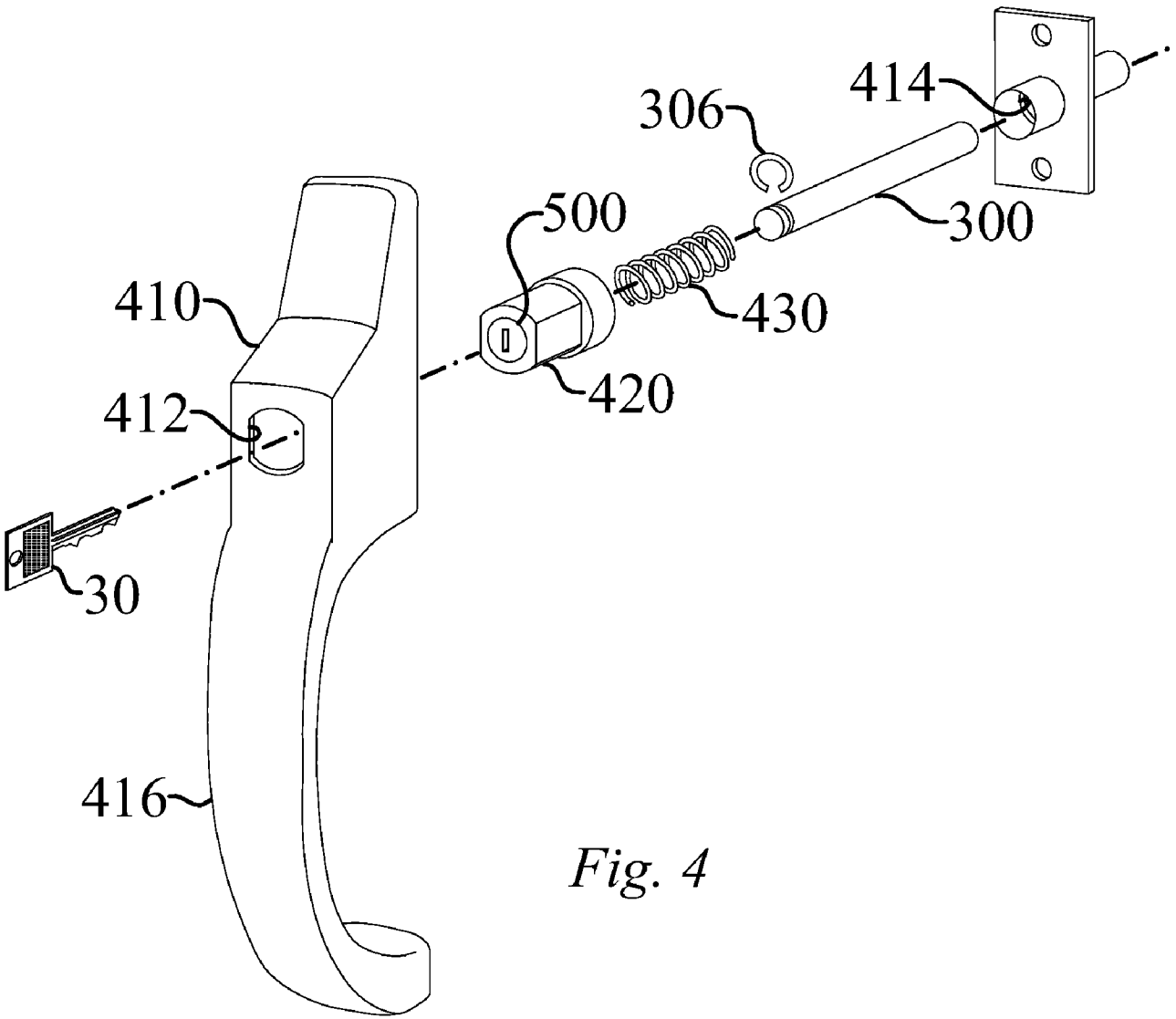
FIG. 4 is an exploded perspective view of an embodiment of the actuation mechanism, locking mechanism, and release pin, not to scale.
Figure 6:
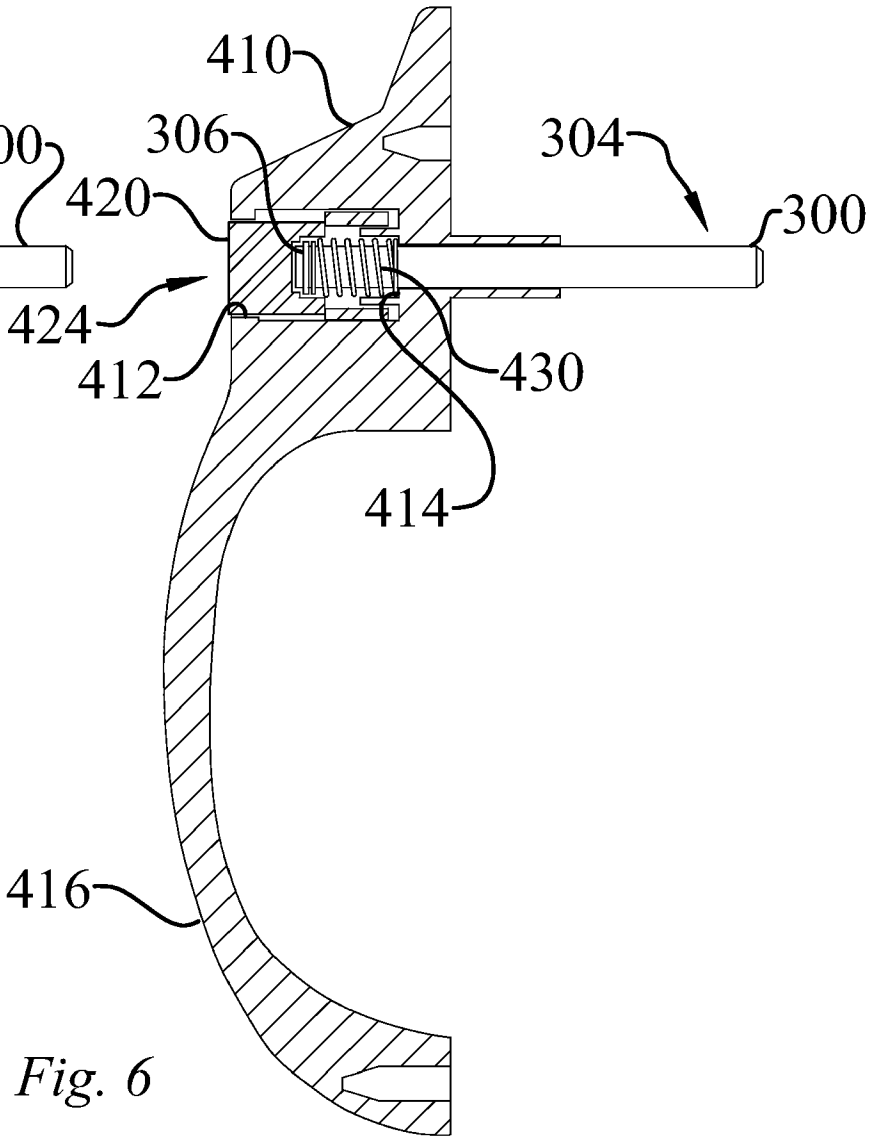
FIG. 6 is a cross-section view showing an embodiment of the actuation mechanism with the release pin in the engaged position, not to scale.
Figure 5:
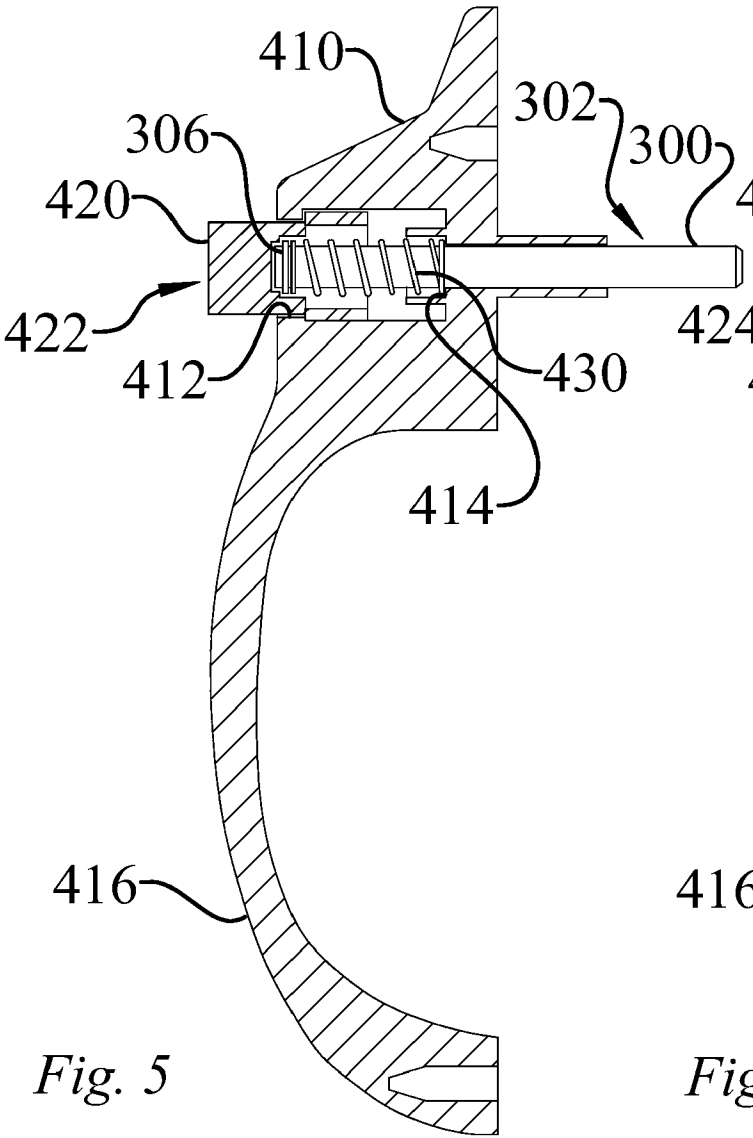
FIG. 5 is a cross-section view showing an embodiment of the actuation mechanism with the release pin in the disengaged position, not to scale.

Referring now to FIG. 4, an embodiment of the actuation mechanism (400) is illustrated. In this embodiment, the actuation mechanism (400) generally includes a housing (410), a push button (420), and a spring (430). The housing (410) may be formed with a seating recess (412), a stopping shoulder (414), and a handle (416). The push button (420) may be designed to receive a portion of the release pin (300) and may be configured to slidably cooperate with the seating recess (412). The push button (420) may be moved between a non-compressed position (422), seen in FIG. 5, and a compressed position (424), seen in FIG. 6. The spring (430) may be sized to receive and encircle a portion of the release pin (300) and is configured to be compressed against the stopping shoulder (414). The stopping shoulder (414) may be a portion of the housing (410) sized to receive the release pin (300) and allow the release pin (300) to move freely therein, or the stopping shoulder (414) may be a separate component. The release pin (300) may also include a retaining ring (306). The retaining ring (306) and the stopping shoulder (414) help secure the spring (430) in place within the housing (410) and also provide surfaces between which the spring (430) may be compressed.

When a compressive force is applied to the push button (420), the push button (420) moves from the non-compressed position (422) to the compressed position (424). This movement transfers the release pin (300) from the disengaged position (302) to the engaged position (304), which results in the bracing arm (200) pivoting to the unsecured position (204). When the compressive force is removed, the spring (430) biases the push button (420) back to the non-compressed position (422), which allows the bracing arm (200) to pivot back to the secured position (202).

In another embodiment of the present invention, the externally releasable security bar system (50) may include a locking mechanism (500). The locking mechanism (500) allows for the selective operation of the actuation mechanism (400). For example, when the locking mechanism (500) is locked, the actuation mechanism (400) is inoperable such that the release pin (300) cannot be transferred to the engaged position (304) to pivot the bracing arm (200) to the unsecured position (204). However, when the locking mechanism (500) is unlocked, the actuation mechanism (400) is operable to transfer the release pin (300) to the engaged position (304), which results in the bracing arm (200) pivoting to the unsecured position (204) to allow unobstructed entry through the door (10).

In one embodiment, the locking mechanism (500) may be a conventional type of lock operated by a key (30), as seen in FIG. 4. For example, the locking mechanism (500) may be similar to the key-operated locks commonly found in the handles of storm doors. However, one with skill in the art would appreciate that virtually any type of lock may be utilized, including, but not limited to, a pin tumbler lock, a cylinder lock, a padlock, and electronic locks having numerical code authentication, security token authentication, or biometric authentication, such as fingerprint scanning.

In yet another embodiment of the present invention, the externally releasable security bar system (50) may be configured such that the locking mechanism (500) is housed within the push button (420), as seen in FIG. 4. In this embodiment, when the locking mechanism (500) is locked, the push button (420) is prevented from moving to the compressed position (424), and thus, the release pin (300) may not be transferred to the engaged position (304). Conversely, when the locking mechanism (500) is unlocked, the push button (420) is readily movable to the compressed position (424) such that the release pin (300) may be transferred to the engaged position (304), which causes the bracing arm (200) to pivot to the unsecured position (204).

Figure 7:
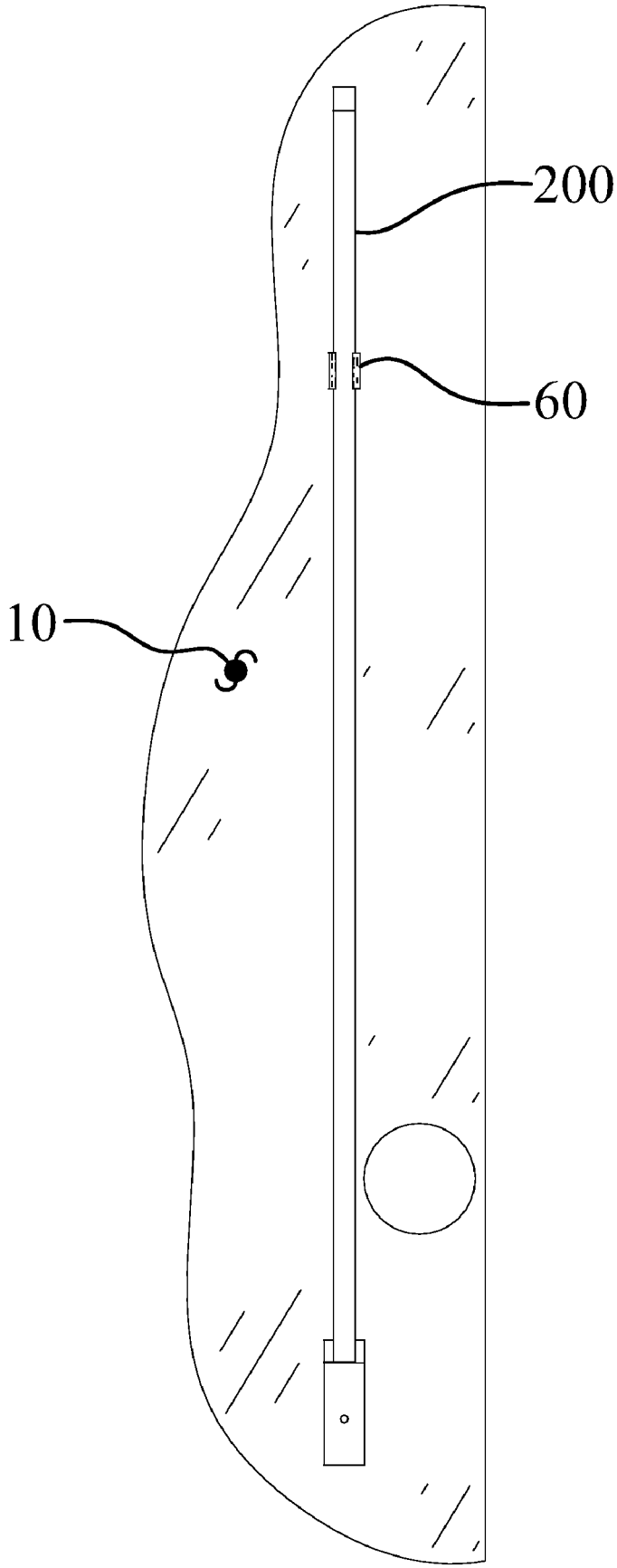
FIG. 7 is an elevation view of an embodiment of the externally releasable security bar system when not in use, not to scale.

In still another embodiment, the externally releasable security bar system (50) may further include a storage clip (60). The storage clip (60) may be fixedly secured to the inside surface of the door (10) and configured to retain a portion of the bracing arm (200) when the externally releasable security bar system (50) is not in use, as seen in FIG. 7. The securement of the storage clip (60) to the door (10) may be accomplished by a variety of means, including, but not limited to, mechanical fasteners, adhesives, or a combination of mechanical fasteners and adhesives. The storage clip (60) may be a type of resilient clip formed from a variety of materials, such as plastics, rubber, metals, or any other type of resilient material.

The storage clip (60) eliminates any problem associated with storing the externally releasable security bar system (50). For example, in one embodiment, if the externally releasable security bar system (50) is not in use, the bracing arm (200) may be pivoted from the secured position (202) to a substantially vertical position and placed within the storage clip (60). The bracing arm (200) may be designed and installed such that it pivots about 150 degrees or more to reach the substantially vertical position, flush with the door (10), as seen in FIG. 7. Of course, one with skill in the art would appreciate that the bracing arm (200) may be designed and installed such that it is required to pivot less than 150 degrees to reach the substantially vertical position. In the substantially vertical position, the bracing arm (200) is completely out of the way and not dragging on the floor surface (20), which allows unimpeded entry through the door (10). When the externally releasable security bar system (50) is desired to be put back in use, the bracing arm (200) may be removed from the storage clip (60) and allowed to pivot to the secured position (202).

The components of the externally releasable security bar system (50) may be fabricated from various materials. For example, the mounting plate (100), bracing arm (200), release pin (300), and actuation mechanism (400) may be constructed from a number of materials, including, but not limited to, high strength aluminum, high strength plastics, steel, combinations of these materials, or any other type of material that is lightweight and durable.

In operation, an occupant would first open the door (10) with the bracing arm (200) in the unsecured position (204). When exiting through the door (10), the occupant may allow the bracing arm (200) to pivot to the secured position (202) with the distal end (220) contacting the floor surface (20). The distal end (220) will drag along the floor surface (20) when closing the door (10) until the door (10) is completely closed. At this point, the bracing arm (200) will be in the secured position (202). Before or after exiting through the door (10), the occupant may lock the locking mechanism (500) so that the actuation mechanism (400) is not capable of transferring the release pin (300) to the engaged position (304).

Upon returning to the structure and desiring entry through the door (10), the occupant may unlock the locking mechanism (500) so that the actuation mechanism (400) is in an operable mode. Next, the occupant may use the actuation mechanism (400) to transfer the release pin (300) from the disengaged position (302) to the engaged position (304). When the release pin (300) is moved to the engaged position (304), the release pin (300) causes the bracing arm (200) to pivot to the unsecured position (204). In the unsecured position (204), the distal end (220) is no longer in contact with the floor surface (20), and the occupant is able to open the door (10) without obstruction. The occupant may then choose to lock the locking mechanism (500) to disable the actuation mechanism (400) before closing the door (10).

The externally releasable security bar system (50) of the present invention may be available as an after-market kit. Providing the externally releasable security bar system (50) as an after-market kit would allow any do-it-yourselfer to retrofit any type of door (10) with the externally releasable security bar system (50). The after-market kit may include all of the components of the externally releasable security bar system (50), as well as any fasteners required for proper installation.

Numerous alterations, modifications, and variations of the embodiments disclosed herein will be apparent to those skilled in the art and they are all anticipated and contemplated to be within the spirit and scope of the instant invention. For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the present invention are described herein, it is to be understood that the practice of such additional modifications and variations and the equivalents thereof, are within the spirit and scope of the invention as defined in the following claims.

I claim:

1. An externally releasable security bar system (50) for mounting on an inside surface of an inwardly swinging door (10) and engaging a floor surface (20) to prevent unauthorized entry through the door (10), comprising:

(a) a mounting plate (100) fixedly secured to the inside surface of the door (10);

(b) a bracing arm (200) having a proximal end (210) and a distal end (220), wherein the proximal end (210) is pivotally connected to the mounting plate (100) such that the bracing arm (200) may pivot between a secured position (202), wherein the distal end (220) is in contact with the floor surface (20), and an unsecured position (204), wherein the distal end (220) is elevated from the floor surface (20);

(c) a release pin (300) operable to pivot the bracing arm (200) from the secured position (202) to the unsecured position (204), wherein the release pin (300) has a position (302) disengaged from the bracing arm (200) secured position (202) and a position (304) engaged with the bracing arm (200) unsecured position (204);

(d) an actuation mechanism (400) operable to transfer the release pin (300) from the disengaged position (302) to the engaged position (304); and (e) a locking mechanism (500) for allowing selective operation of the actuation mechanism (400) such that when the locking mechanism (500) is locked, the actuation mechanism (400) is inoperable, and when the locking mechanism (500) is unlocked, the actuation mechanism (400) is operable.

2. The externally releasable security bar system (50) of claim 1, wherein the actuation mechanism (400) includes:

(a) a housing (410) formed with a seating recess (412), a stopping shoulder (414), and a handle (416);

(b) a push button (420) designed to receive a portion of the release pin (300) and configured to slidably cooperate with the seating recess (412), wherein the push button (420) is movable between a non-compressed position (422) and a compressed position (424);

(c) a spring (430) sized to receive and encircle a portion of the release pin (300) and configured for compressing against the stopping shoulder (414); and wherein applying a compressive force to the push button (420) moves the push button (420) from the non-compressed position (422) to the compressed position (424), which transfers the release pin (300) from the disengaged position (302) to the engaged position (304), and wherein removing the compressive force from the push button (420) allows the spring (430) to bias the push button (420) to the non-compressed position (422).

3. The externally releasable security bar system (50) of claim 1, wherein the bracing arm (200) includes an angled tip at the distal end (220), the angled tip having an angle of about 20 degrees to about 30 degrees from the horizontal to engage the floor surface (20).

4. The externally releasable security bar system (50) of claim 1, further including a foot (230) having a friction enhancing surface, wherein the foot (230) is pivotally joined to the distal end (220) of the bracing arm (200).

5. The externally releasable security bar system (50) of claim 1, further including a storage clip (60) fixedly secured to the inside surface of the door (10), wherein the storage clip (60) is configured to retain a portion of the bracing arm (200) when the externally releasable security bar system (50) is not in use.

6. The externally releasable security bar system (50) of claim 1, wherein the bracing arm (200) is pivotally connected to the mounting plate (100) such that the bracing arm (200) may pivot to a substantially vertical position when the externally releasable security bar system (50) is not in use.

7. The externally releasable security bar system (50) of claim 1, wherein the bracing arm (200) includes a plurality of telescoping arm sections (240) for selectively lengthening and shortening the bracing arm (200).

8. The externally releasable security bar system (50) of claim 1, wherein the release pin (300) comprises a multi-section threaded pin for selective lengthening and shortening of the release pin (300).

9. The externally releasable security bar system (50) of claim 2, wherein the locking mechanism (500) is housed within the push button (420).

10. The externally releasable security bar system (50) of claim 3, wherein the angled tip at the distal end (220) includes a friction enhancing surface.

11. An externally releasable security bar system (50) for mounting on an inside surface of an inwardly swinging door (10) and engaging a floor surface (20) to prevent unauthorized entry through the door (10), comprising:

(a) a mounting plate (100) fixedly secured to the inside surface of the door (10);

(b) a bracing arm (200) having a proximal end (210) and a distal end (220), wherein the proximal end (210) is pivotally connected to the mounting plate (100) such that the bracing arm (200) may pivot between a secured position (202), wherein the distal end (220) is in contact with the floor surface (20), and an unsecured position (204), wherein the distal end (220) is elevated from the floor surface (20);

(c) a release pin (300) operable to pivot the bracing arm (200) from the secured position (202) to the unsecured position (204), wherein the release pin (300) has a position (302) disengaged from the bracing arm (200) secured position (202) a position (304) engaged with the bracing arm (200) unsecured position (204);

(d) an actuation mechanism (400) operable to transfer the release pin (300) from the disengaged position (302) to the engaged position (304), wherein the actuation mechanism (400) includes:

(i) a housing (410) formed with a seating recess (412), a stopping shoulder (414), and a handle (416);

(ii) a push button (420) designed to receive a portion of the release pin (300) and configured to slidably cooperate with the seating recess (412), wherein the push button (420) is movable between a non-compressed position (422) and a compressed position (424);

(iii) a spring (430) sized to receive and encircle a portion of the release pin (300) and configured for compressing against the stopping shoulder (414); and wherein applying a compressive force to the push button (420) moves the push button (420) from the non-compressed position (422) to the compressed position (424), which transfers the release pin (300) from the disengaged position (302) to the engaged position (304), and wherein removing the compressive force from the push button (420) allows the spring (430) to bias the push button (420) to the non-compressed position (422); and (e) a locking mechanism (500) for allowing selective operation of the actuation mechanism (400) such that when the locking mechanism (500) is locked, the actuation mechanism (400) is inoperable, and when the locking mechanism (500) is unlocked, the actuation mechanism (400) is operable.

12. The externally releasable security bar system (50) of claim 11, wherein the bracing arm (200) includes an angled tip at the distal end (220), the angled tip having an angle of about 20 degrees to about 30 degrees from the horizontal to engage the floor surface (20).

13. The externally releasable security bar system (50) of claim 11, further including a foot (230) having a friction enhancing surface, wherein the foot (230) is pivotally joined to the distal end (220) of the bracing arm (200).

14. The externally releasable security bar system (50) of claim 11, further including a storage clip (60) fixedly secured to the inside surface of the door (10), wherein the storage clip (60) is configured to retain a portion of the bracing arm (200) when the externally releasable security bar system (50) is not in use.

15. The externally releasable security bar system (50) of claim 11, wherein the bracing arm (200) is pivotally connected to the mounting plate (100) such that the bracing arm (200) may pivot to a substantially vertical position when the externally releasable security bar system (50) is not in use.

16. The externally releasable security bar system (50) of claim 11, wherein the bracing arm (200) includes a plurality of telescoping arm sections (240) for selectively lengthening and shortening the bracing arm (200).

17. The externally releasable security bar system (50) of claim 11, wherein the locking mechanism (500) is housed within the push button (420).

18. The externally releasable security bar system (50) of claim 11, wherein the release pin (300) comprises a multi-section threaded pin for selectively lengthening and shortening the release pin (300).

19. The externally releasable security bar system (50) of claim 12, wherein the angled tip at the distal end (220) includes a friction enhancing surface.

20. An externally releasable security bar system (50) for mounting on an inside surface of an inwardly swinging door (10) and engaging a floor surface (20) to prevent unauthorized entry through the door (10), comprising:

(a) a mounting plate (100) fixedly secured to the inside surface of the door (10);

(b) a bracing arm (200) having a proximal end (210), a distal end (220), and a plurality of telescoping arm sections (240), wherein the proximal end (210) is pivotally connected to the mounting plate (100) such that the bracing arm (200) may pivot between a secured position (202) corresponding to the distal end (220) contacting the floor surface (20), and an unsecured position (204) corresponding to the distal end (220) being elevated from the floor surface (20);

(c) a release pin (300) operable to pivot the bracing arm (200) from the secured position (202) to the unsecured position (204), wherein the release pin (300) has a position (302) disengaged from the bracing arm (200) secured position (202) and a position (304) engaged with the bracing arm (200) unsecured position (204), and wherein the release pin (300) comprises a multi-section threaded pin for selectively lengthening and shortening the release pin (300);

(d) an actuation mechanism (400) operable to transfer the release pin (300) from the disengaged position (302) to the engaged position (304), wherein the actuation mechanism (400) includes:

(i) a housing (410) formed with a seating recess (412), a stopping shoulder (414), and a handle (416);

(ii) a push button (420) designed to receive a portion of the release pin (300) and configured to slidably cooperate with the seating recess (412), wherein the push button (420) is movable between a non-compressed position (422) and a compressed position (424);

(iii) a spring (430) sized to receive and encircle a portion of the release pin (300) and configured for compressing against the stopping shoulder (414); and wherein applying a compressive force to the push button (420) moves the push button (420) from the non-compressed position (422) to the compressed position (424), which transfers the release pin (300) from the disengaged position (302) to the engaged position (304), and wherein removing the compressive force from the push button (420) allows the spring (430) to bias the push button (420) to the non-compressed position (422); and (e) a locking mechanism (500) for allowing selective operation of the actuation mechanism (400) such that when the locking mechanism (500) is locked, the actuation mechanism (400) is inoperable, and when the locking mechanism (500) is unlocked, the actuation mechanism (400) is operable.

* * * * *